US005471810A

United States Patent [19]

Sugisawa et al.

[11] Patent Number: 5,471,810

[45] Date of Patent: Dec. 5, 1995

[54] BUCKLING-RESTRICTION BRACING MEMBER

[75] Inventors: Mitsuru Sugisawa, Funabashi; Hideji Nakamura, Ichikawa; Atsushi Watanabe, Musashino, all of Japan

[73] Assignee: Nippon Steel Corporation, Otemachi, Japan

[21] Appl. No.: 289,865

[22] Filed: Aug. 12, 1994

Related U.S. Application Data

[63] Continuation of Ser. No. 897,208, Jun. 11, 1992, abandoned.

[30] Foreign Application Priority Data

Jun. 27, 1991 [JP] Japan ..... 3-057136

[51] Int. Cl.[6] ..... F04C 3/32; F04H 9/02

[52] U.S. Cl. ..... 52/731.7; 52/167.3; 52/730.6; 52/731.1

[58] Field of Search ..... 52/727, 728, 730.1, 52/730.3, 730.6, 731.1, 731.7, 731.8, 167 CB, 167 T, 167 R, 729

[56] References Cited

FOREIGN PATENT DOCUMENTS

| | | | |
|---|---|---|---|
| 3101603 | 7/1988 | Japan | 52/167 CB |
| 1187271 | 7/1989 | Japan | 52/167 CB |
| 199582 | 8/1991 | Japan | 52/167 R |
| 71242 | 3/1993 | Japan | 52/167 R |

*Primary Examiner*—Michael Safavi
*Attorney, Agent, or Firm*—Joseph C. Mason, Jr.; Ronald E. Smith

[57] ABSTRACT

A steel center axis force member passes through a steel buckling-restriction member. A stick preventing coat is disposed between the surface of the center axis force member and the buckling-restriction member. Thereby, a buckling-restriction bracing member having a narrower body and lighter weight can be provided to facilitate a rapid manufacture with lower cost.

2 Claims, 9 Drawing Sheets

BUCKLING-RESTRICTION BRACING MEMBER

This application is a continuation of U.S. application Ser. No. 07/897,208, filed Jun. 11, 1992, now abandoned.

BACKGROUND OF THE INVENTION

1. Field of the Invention

This invention relates to a new buckling-restriction bracing member used as a structural element resisting a horizontal force, such as an earthquake force or wind force, for a structure such as a building or the like.

2. Description of the Prior Art

A bucking-restriction bracing member used for a structure such as a building or the like is well known in the art. As disclosed in Japanese Utility Model Laid-open No. 63-101603, the conventional buckling-restriction bracing member comprises a steel center axis force member passing through a buckling-restriction concrete member reinforced by a steel material, and a stick preventing coat disposed between the surface of the center axis force member and the concrete member.

The conventional buckling-restriction bracing member set forth above has significant drawbacks. The buckling-restriction bracing member is made of the buckling-restriction concrete member reinforced by the steel material. Accordingly, it is disadvantageous, e.g., to transport, carry, or erect (lift by a crane) the buckling-restriction bracing member during construction due to heavy weight thereof. Concrete is filled into a steel pipe to manufacture the buckling-restriction concrete member reinforced by the steel material. The buckling-restriction concrete member requires complicated manufacturing processes such as installation of form, provision of concrete, cure for concrete, and removal of form, thereby resulting in high cost. Additionally, the cure for concrete takes a few days so that a long term is required for manufacturing the buckling-restriction bracing member. There is another disadvantage that a larger buckling-restriction bracing member causes a greater dead space in view of a building plan.

SUMMARY OF THE INVENTION

It is a principal object of the present invention to provide a narrower and lighter buckling-restriction bracing member comprising a steel center axis force member passing through a steel buckling-restriction member, and a stick preventing coat disposed between the surface of the steel center axis force member and the buckling-restriction member.

It is another object of the present invention to enable to more rapidly manufacture the buckling-restriction bracing member with lower cost.

BRIEF DESCRIPTION OF THE DRAWINGS

The foregoing and other objects and features of the invention will become apparent from the following description of preferred embodiments of the invention with reference to the accompanying drawings, in which.

DETAILED DESCRIPTION OF THE PREFERRED EMBODIMENTS

Figure 1:
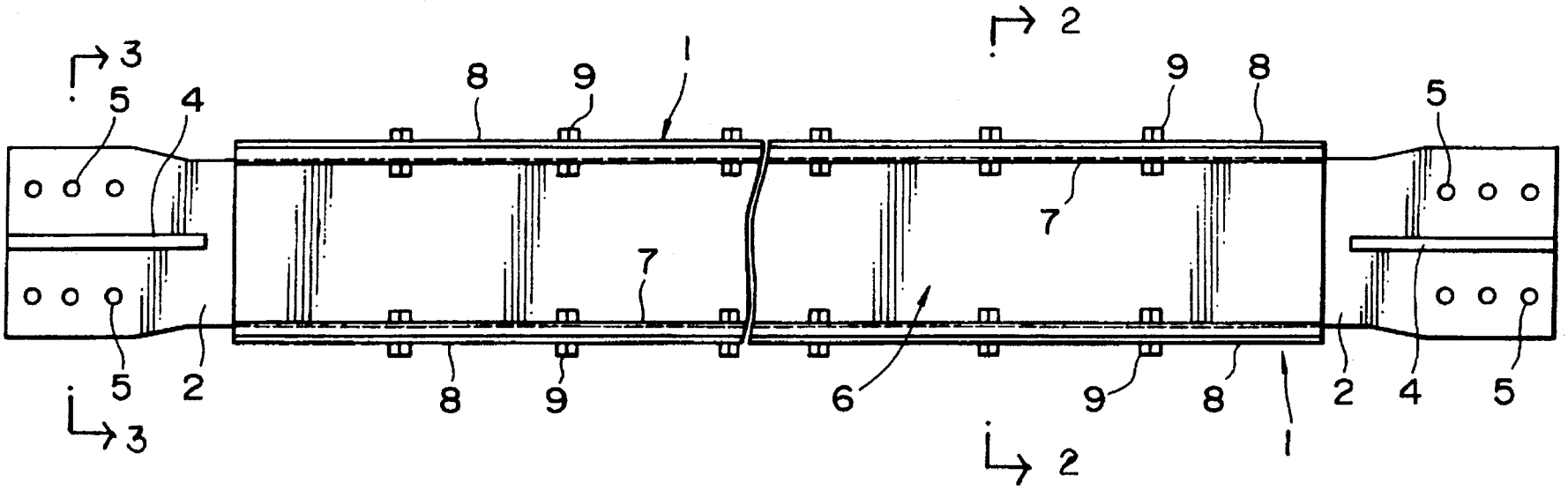
FIG. 1 is a side view, partially cut away, showing a first embodiment of a buckling-restriction bracing member according to the present invention.
Figure 2:
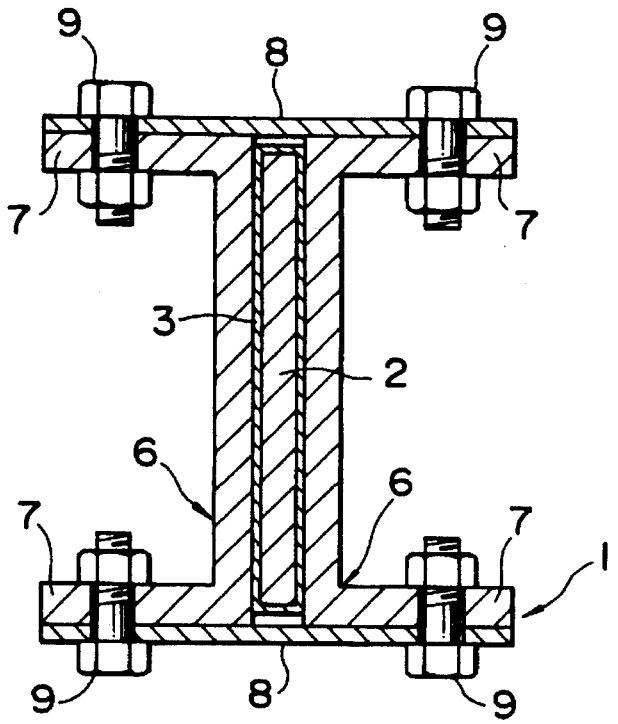
FIG. 2 is an enlarged sectional view taken along line 2—2 of FIG. 1.
Figure 3:
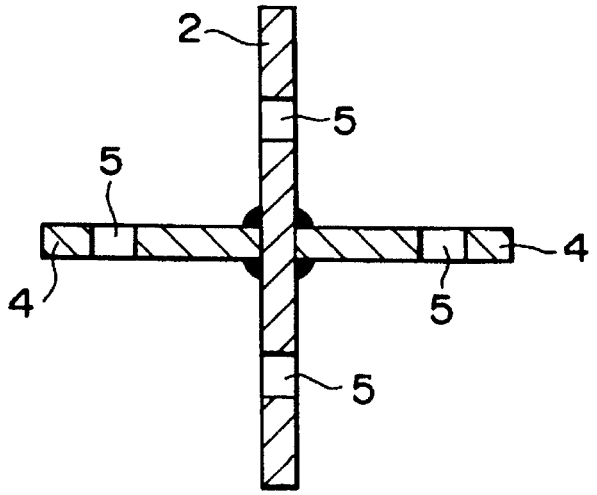
FIG. 3 is an enlarged sectional view taken along line 3—3 in FIG. 1.

FIGS. 1 through 3 show a buckling-restriction bracing member according to a first embodiment of the present invention. In a steel buckling-restriction member 1, steel rib plates 4 for reinforcement are rigidly fixed by welding on the respective surfaces of the respective ends of a steel center axis force member 2 which is formed of band steel plate. A plurality of bolt through holes 5 are provided in the respective ends of the steel center axis force member 2 and the rib plates 4. A stick preventing coat 3 is applied to the whole surface of an intermediate portion of the steel center axis force member 2. Steel buckling-restriction member bodies 6 each having a channel section are disposed on the respective sides of the steel center axis force member 2. Band steel plates 8 are disposed along flanges 7 of the respective steel buckling-restriction member bodies 6. The flanges 7 are clamped with many bolts 9 to the band steel plates 8. Further, the stick preventing coat 3 contacts with the whole inner periphery of the steel buckling-restriction member 1.

Figure 4:
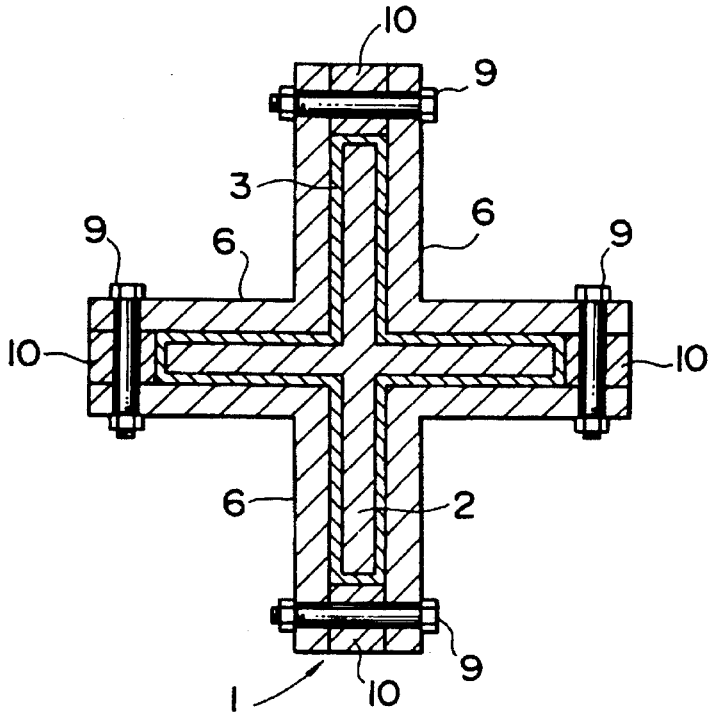
FIG. 4 is a sectional view showing a second embodiment of a buckling-restriction bracing member according to present invention.

FIG. 4 shows a buckling-restriction bracing member according to a second embodiment of the present invention. In a steel buckling-restriction member 1, a steel center axis force member 2 has a cross-shaped section. Four steel buckling-restriction member bodies 6 each having an L-shaped section are disposed around the steel center axis force member 2. Rod-type steel spacers 10 are disposed between the respective side edges of the adjacent steel buckling-restriction member bodies 6. The respective side edges of the adjacent steel buckling-restriction member bodies 6 are clamped with many bolts 9. The rest is the same construction as in the case of the first embodiment as shown in FIGS. 1 through 3.

Figure 5:
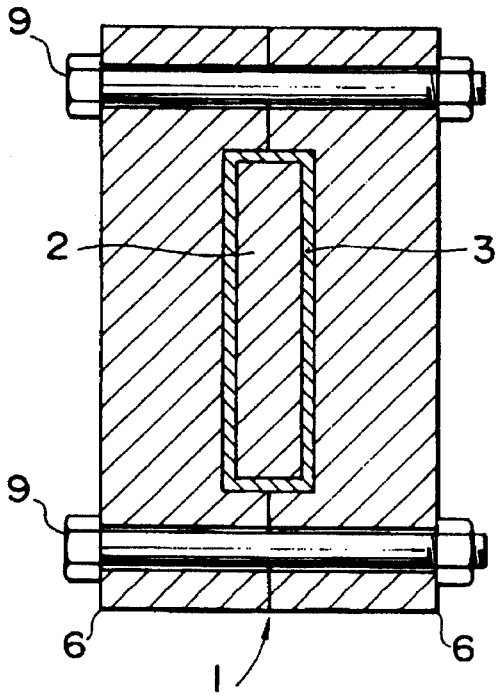
FIG. 5 is a sectional view showing a third embodiment of a buckling-restriction bracing member according to the present invention.

FIG. 5 shows a buckling-restriction bracing member according to a third embodiment of the present invention. In a steel buckling-restriction member 1, two steel buckling-restriction member bodies 6 each provided with a groove having a channel section are disposed such that the respective grooves are opposed to each other. The respective side edges of the respective steel buckling-restriction member bodies 6 are clamped with many bolts 9. The rest is the same construction as in the case of the first embodiment as shown in FIGS. 1 through 3.

Figure 6:
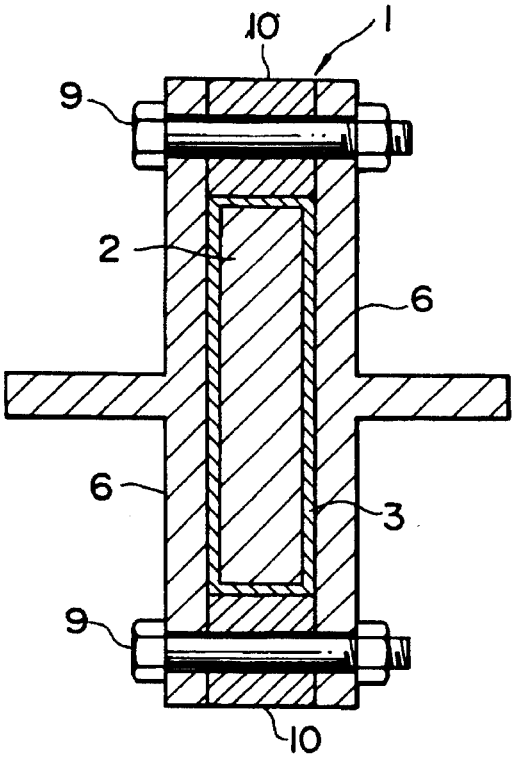
FIG. 6 is a sectional view showing a fourth embodiment of a buckling-restriction bracing member according to the present invention.

FIG. 6 shows a buckling-restriction bracing member according to a fourth embodiment of the present invention. In a steel buckling-restriction member 1, two steel buckling restriction member bodies 6 each having a T-shaped section are disposed such that respective plate portions of the steel buckling-restriction member bodies 6 are disposed in spaced apart parallelism with each other. Rod-type steel spacers 10 are disposed between the respective side edges of the respective steel buckling-restriction member bodies 6. The side edges of the respective steel buckling-restriction member bodies 6 are clamped with many bolts 9. The rest is the same construction as in the case of the first embodiment as shown in FIGS. 1 through 3.

Figure 7:
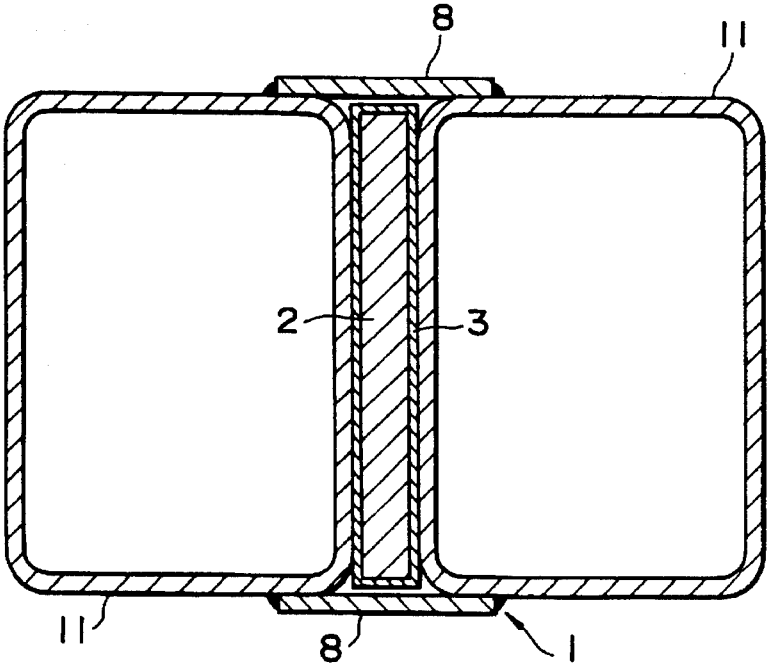
FIG. 7 is a sectional view showing a fifth embodiment of a buckling-restriction bracing member according to the present invention.

FIG. 7 shows a buckling-restriction bracing member according to a fifth embodiment of the present invention. In a steel buckling-restriction member 1, two square steel pipes 11 are disposed in spaced apart parallelism with each other. Band steel plates 8 are disposed between a pair of coplanar plate bodies of the two square steel pipes 11. The respective side edges of the band steel plates 8 are rigidly fixed by welding on the square steel pipes 11. The rest is the same construction as in the case of the first embodiment as shown in FIGS. 1 through 3.

Figure 8:
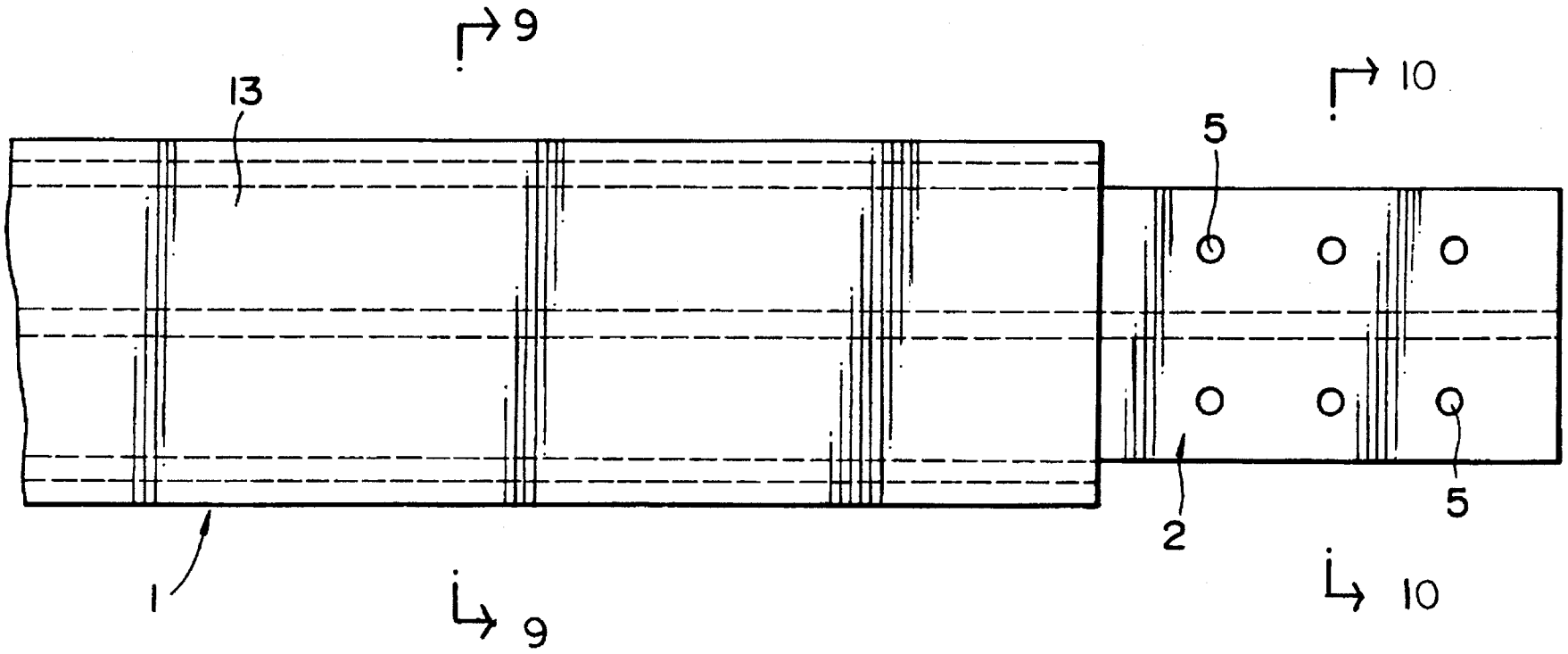
FIG. 8 is a partial side view showing a sixth embodiment of a buckling-restriction bracing member according to the present invention.
Figure 9:
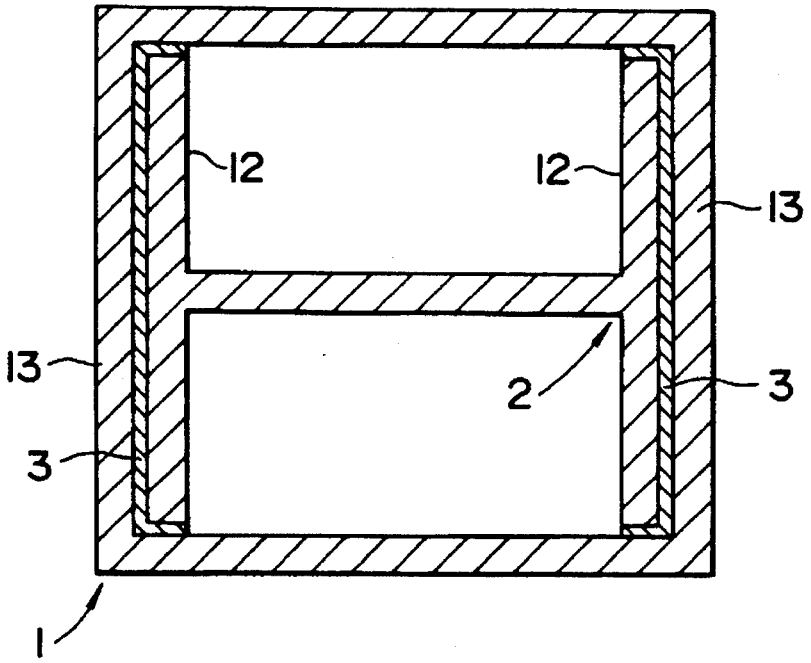
FIG. 9 is an enlarged sectional view taken along line 9—9 of FIG. 8.
Figure 10:
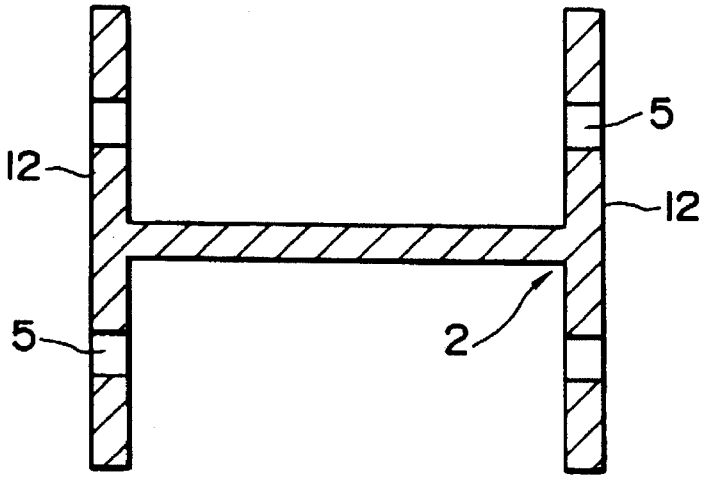
FIG. 10 is an enlarged sectional view taken along line 10—10 of FIG. 8.

FIGS. 8 through 10 show a buckling-restriction member according to a sixth embodiment of the present invention. The buckling-restriction bracing member includes a steel center axis force member 2 having an H-shaped section, and a steel buckling-restriction member 1 formed of a square steel pipe. Further, a stick preventing coat 3 is closely disposed between the respective flanges 12 of the steel center axis force member 2 and the plate bodies 13 of the steel buckling-restriction member 1. A plurality of bolt through holes 5 are provided in the respective ends of the steel center axis force member 2.

Figure 11:
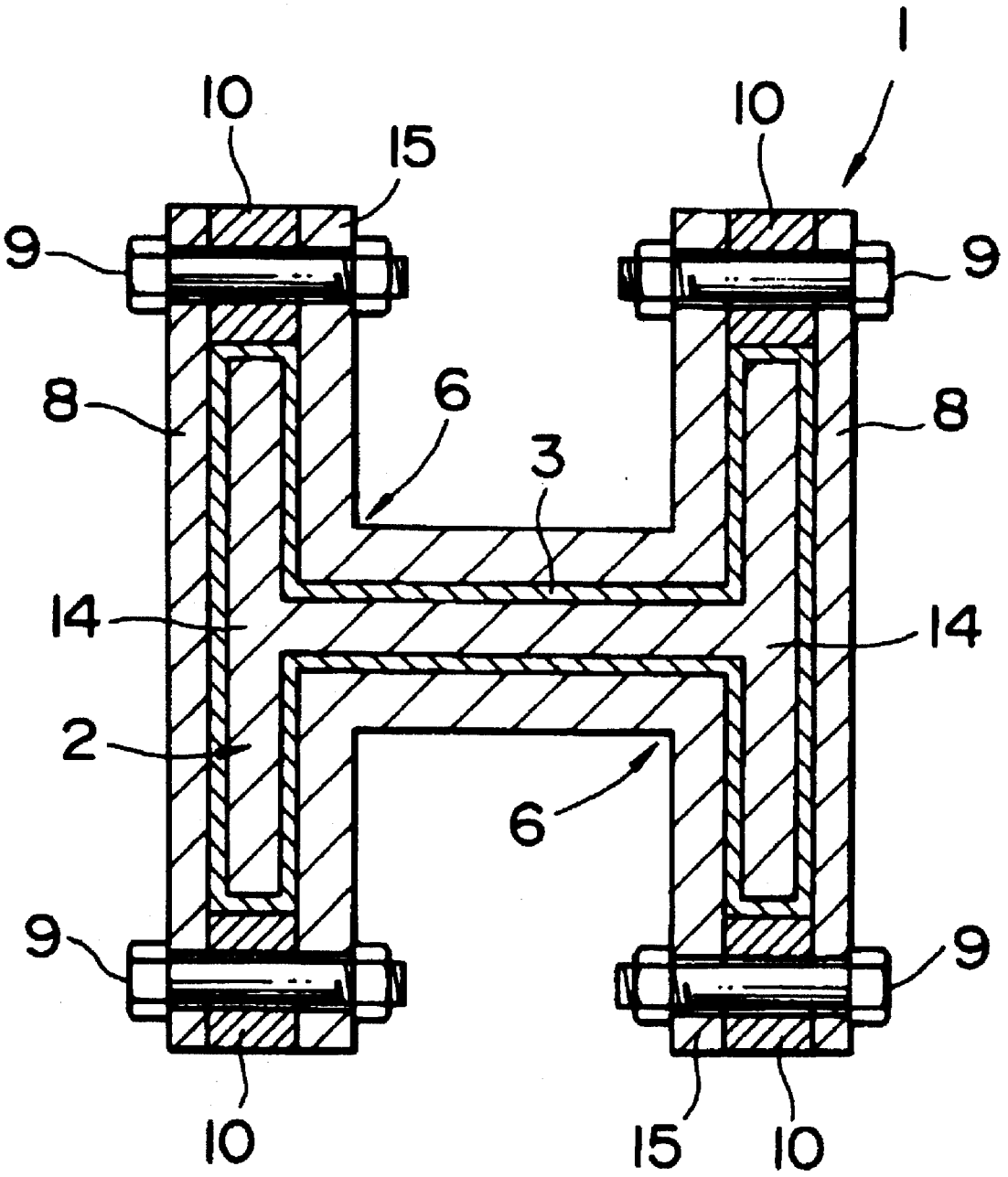
FIG. 11 is a sectional view showing a seventh embodiment of a buckling-restriction bracing member according to the present invention.

FIG. 11 shows a buckling-restriction member according to a seventh embodiment of the present invention. A steel buckling-restriction member 1 comprises a steel center axis force member 2 having a H-shaped section. A pair of steel buckling-restriction member bodies 6 each having a channel section are disposed in grooves of the steel center axis force member 2. Band steel plates 8 are disposed in overlying relation to the outer surface of the respective flanges 14 of the steel center axis force member 2. Rod-type steel spacers 10 are disposed between the respective sides of the band steel plates 8 and the flanges 15 of the steel buckling-restriction member bodies 6. The side edges of the band steel plates 8 and the side edges of the flanges 15 of the steel buckling-restriction member bodies 6 and the steel spacers 10 are clamped with bolts 9. A stick preventing coat 3 is closely disposed between the whole periphery of the steel center axis force member 2 and the inner periphery of the steel buckling-restriction member 1. A plurality of bolt through holes are provided in the flanges 14 at the respective ends of the steel center axis force member 2.

Figure 12:
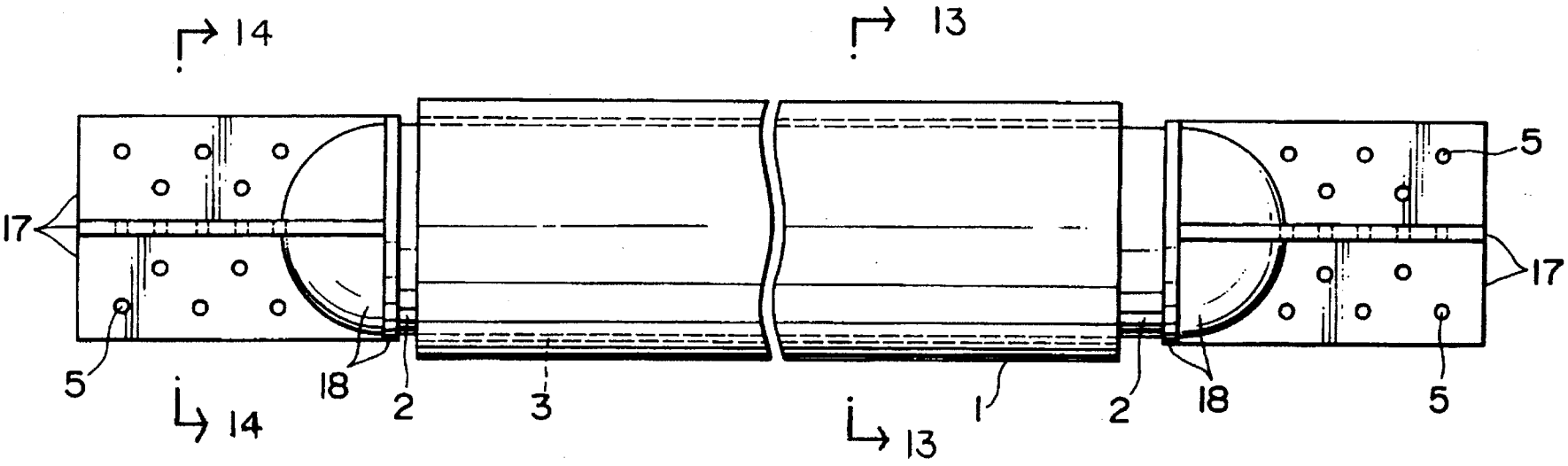
FIG. 12 is a side view, partially cut away, showing an eighth embodiment of a buckling-restriction bracing member according to the present invention.
Figure 13:
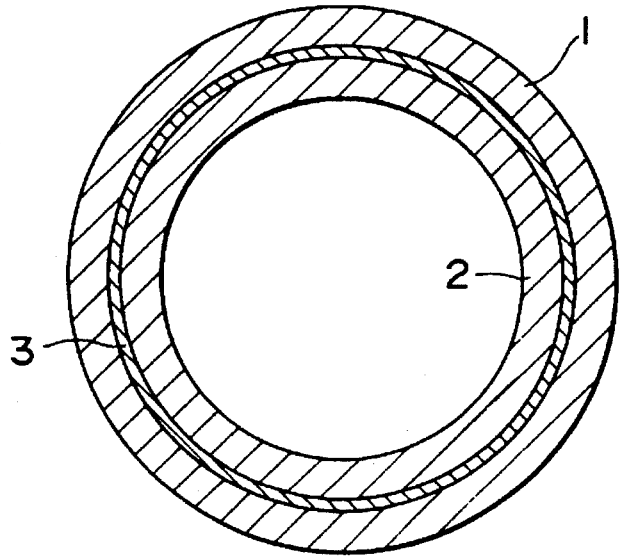
FIG. 13 is an enlarged sectional view taken along line 13—13 of FIG. 12.
Figure 14:
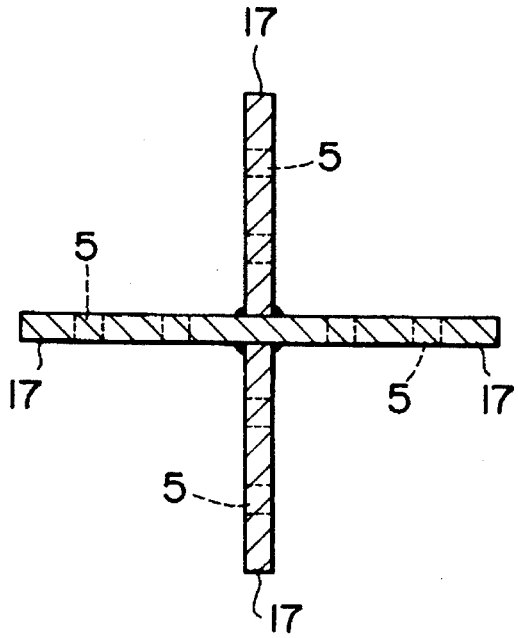
FIG. 14 is an enlarged sectional view taken along line 14—14 of FIG. 12.

FIGS. 12 through 14 show a buckling-restriction member according to an eighth embodiment of the present invention. In a steel buckling-restriction member 1, a steel center axis force member 2 formed of a circular steel pipe passed through the steel buckling-restriction member 1 formed of a circular steel pipe. A stick preventing coat 3 is closely disposed between the steel buckling-restriction member 1 and the whole surface of the steel center axis force member 2. Steel connecting plates 17 with a cross-shaped section have many bolt through holes 5. The steel connecting plates 17 are rigidly fixed by welding through steel connectors 18 on the respective ends of the steel center axis force member 2 projecting from the respective ends of the steel buckling-restriction member 1.

Form parting agent, oil paint, asphalt, tar, rubber and so on may be used as the stick preventing coat 3 of the present invention.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described.

What is claimed is:

1. A device for bracing a structure, comprising:

an elongate steel center axis force member of continuous construction;

said elongate steel center axis force member having opposite ends with bolt-receiving through holes formed therein;

a pair of steel buckling-restriction members of continuous construction;

said elongate steel center axis force member disposed in sandwiched relation to said steel buckling-restriction members along substantially the entire length of said elongate steel center axis force member, excepting said opposite ends;

a nonstick coating disposed between said elongate center axis force member and each steel buckling-restriction member of said pair of steel buckling-restriction members; and fastening means for fixedly securing said elongate steel center axis force member into said sandwiched relation to said pair of steel buckling-restriction members;

each steel buckling-restriction member of said pair of steel buckling-restriction members being spaced apart from said elongate steel center axis force member only by a thickness of said nonstick coating.

2. A device according to claim 1, further comprising a channel-shaped groove formed in each member of said pair of steel buckling-restriction members, said channel-shaped grooves facing one another to collectively form a passageway that receives said elongate steel center axis force member therein.

* * * * *